US009144315B1

(12) United States Patent
Cheng

(10) Patent No.: US 9,144,315 B1
(45) Date of Patent: Sep. 29, 2015

(54) ADJUSTMENT DEVICE OF A CHAIR WITH A FOOT RING

(71) Applicant: Jui-Pin Cheng, Taichung (TW)

(72) Inventor: Jui-Pin Cheng, Taichung (TW)

( * ) Notice: Subject to any disclaimer, the term of this patent is extended or adjusted under 35 U.S.C. 154(b) by 0 days.

(21) Appl. No.: 14/465,985

(22) Filed: Aug. 22, 2014

(51) Int. Cl.
*A47C 20/00* (2006.01)
*A47C 7/50* (2006.01)
*A47C 7/00* (2006.01)

(52) U.S. Cl.
CPC ..... *A47C 7/506* (2013.01); *A47C 7/004* (2013.01)

(58) Field of Classification Search
CPC ..... A47C 7/056; A47C 7/004; A47C 9/007
USPC ..... 297/423.38, 423.35, 411.36, 463.1
See application file for complete search history.

(56) References Cited

U.S. PATENT DOCUMENTS 3,458,234 A * 7/1969 Bates ..... 297/423.38
5,011,104 A * 4/1991 Fang ..... 248/125.8
5,836,555 A * 11/1998 Ellsworth et al. ..... 248/161
5,887,948 A * 3/1999 Hannes ..... 297/411.35
5,984,567 A * 11/1999 Gollin et al. ..... 403/371
5,988,754 A * 11/1999 Lamart et al. ..... 297/423.38
6,520,192 B1 * 2/2003 Lo ..... 135/25.4
6,578,804 B2 * 6/2003 Lin et al. ..... 248/188.7
6,695,407 B1 * 2/2004 Lin ..... 297/423.38
6,761,274 B1 * 7/2004 Chen ..... 211/207
6,862,776 B2 * 3/2005 Chen ..... 16/113.1
7,229,054 B2 * 6/2007 Hu ..... 248/188.1
7,530,639 B2 * 5/2009 Groelsma et al. ..... 297/423.38
8,297,563 B2 * 10/2012 Tsai ..... 248/125.1
8,517,472 B1 * 8/2013 Proctor ..... 297/423.1
2003/0151291 A1 * 8/2003 Lin et al. ..... 297/423.38
2008/0185896 A1 * 8/2008 Wei ..... 297/423.19
2014/0070592 A1 * 3/2014 Yeh ..... 297/423.38
2014/0265512 A1 * 9/2014 Pritchard ..... 297/423.38

* cited by examiner

*Primary Examiner* — Laurie Cranmer
(74) *Attorney, Agent, or Firm* — Rosenberg, Klein & Lee

(57) ABSTRACT

An adjustment device has a foot ring, a first positioning unit, a second positioning unit and a tightening collar. The foot ring has a mounting tube. The first positioning unit and the second positioning unit are mounted in the mounting tube and respectively have an inner threaded portion. The inner threaded portions are connected with each other to form a tapered threaded structure. The tightening collar is tapered and engages with the threaded structure formed by the inner threaded portions. The tightening collar and the positioning units match each by a taper ratio. Therefore, the adjustment device can be assembled around a leg tube firmly.

4 Claims, 7 Drawing Sheets

ADJUSTMENT DEVICE OF A CHAIR WITH A FOOT RING

BACKGROUND OF THE INVENTION

1. Field of the Invention

The present invention relates to a chair adjustment device, and more particularly to an adjustment device of a chair with a foot ring.

2. Description of Related Art

With reference to FIG. 7, a foot ring 61 is mounted on a highchair or an office seat 60. The foot ring 61 has a mounting collar 62 mounted at a middle of the foot ring 61. The foot ring 60 can be mounted around a leg tube 63 of the office seat 60 via the mounting collar 62. The mounting collar 62 has a threaded hole radially formed in the mounting collar 62. The threaded hole is provided for combining with a fixing unit 64. The fixing unit 64 is combined with the threaded hole and is tightened to abut the leg tube 63 to fix a position of the foot ring 61 relative to the leg tube 63.

However, when the position of the foot ring 61 needs to be adjusted, the fixing unit 64 has to be loosened or tightened by a hand tool or a hand of a user. Therefore, the adjustment process is inconvenient for the user, especially for a user with relatively weak physical strength.

Furthermore, the leg tube 63 is a smooth cylinder, but the foot ring 61 is positioned around the leg tube 63 only by the fixing unit 64, such that only a point contact is formed between the fixing unit 64 and the leg tube 63. If the fixing unit 64 is too tightened for abutting the leg tube 63, the leg tube 63 may be damaged. On the other hand, in use, the foot ring 61 may withstand a considerable pedaling force from the user. When the pedaling force is insufficient, the foot ring 61 may be detached from the leg tube 63.

SUMMARY OF THE INVENTION

The main objective of the present invention is to provide an adjustment device of a chair with a foot ring to resolve the afore-mentioned problems.

The adjustment device of a chair with a foot ring has a foot ring, a first positioning unit, a second positioning unit and a tightening collar.

The foot ring has a mounting tube being hollow, a block formed on an inner surface of the mounting tube, multiple ribs radially connected with an outer surface of the mounting tube, and a ring frame connected with ends of the ribs at positions opposite to the mounting tube.

The first positioning unit is curved, is mounted in the mounting tube and has an inner threaded portion formed on a side of the first positioning unit.

The second positioning unit is curved, is mounted in the mounting tube, faces towards the first positioning unit, and has an inner threaded portion formed on a side of the second positioning unit. The side of the second positioning unit faces towards the first positioning unit. The inner threaded portions of the first positioning unit and the second positioning unit are connected with each other to form a tapered and fully threaded structure. The block abuts one of the first positioning unit and the second positioning unit.

The tightening collar engages with the threaded structure formed by the inner threaded portions of the first positioning unit and the second positioning unit and has a collar body, an outer threaded portion and at least one slit. The collar body is hollow and tapered, wherein a taper ratio of the collar body matches a taper ratio of the threaded structure formed by the first positioning unit and the second positioning unit. The outer threaded portion is formed on a side of the collar body and engages with the inner threaded portions of the first positioning unit and the second positioning unit. The at least one slit is formed through the collar body longitudinally.

Other objectives, advantages and novel features of the present invention will become more apparent from the following detailed description when taken in conjunction with the accompanying drawings.

DETAILED DESCRIPTION OF PREFERRED EMBODIMENT

Figure 1:
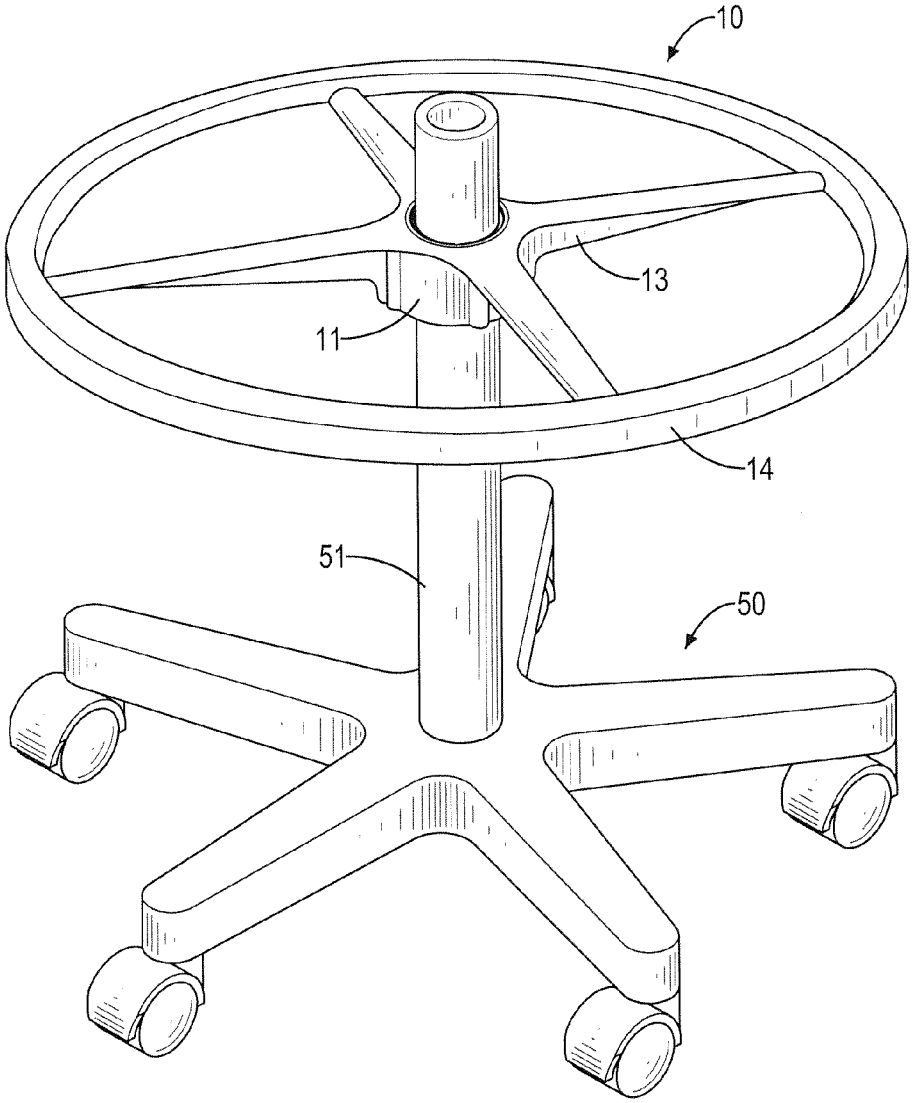
FIG. 1 is a perspective view of a preferred embodiment of an adjustment device of a chair with a foot ring in accordance with the present invention, shown mounted around a chair leg.
Figure 2:
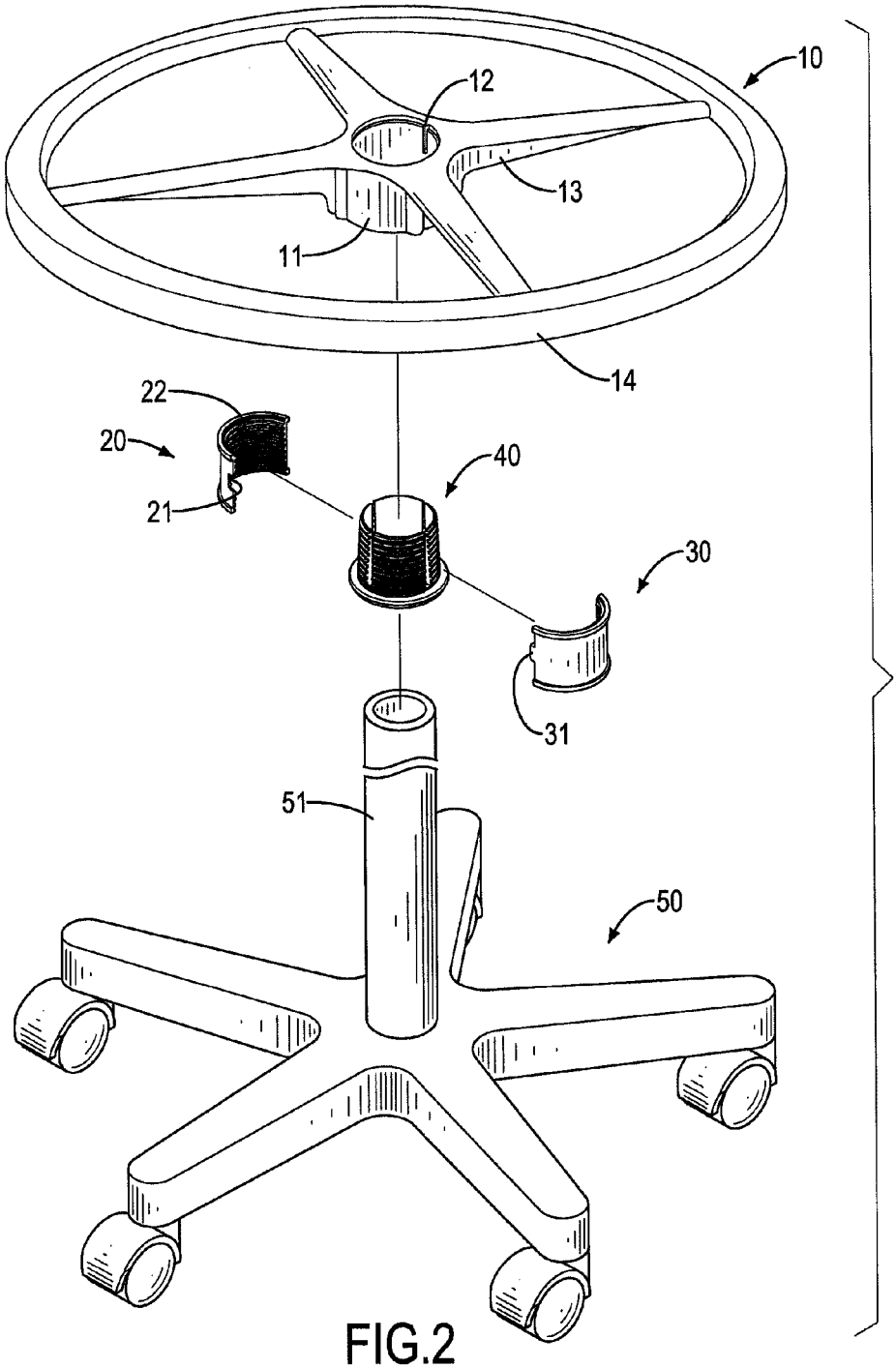
FIG. 2 is an exploded perspective view of the adjustment device in FIG. 1, shown with the chair leg in FIG. 1.
Figure 3:
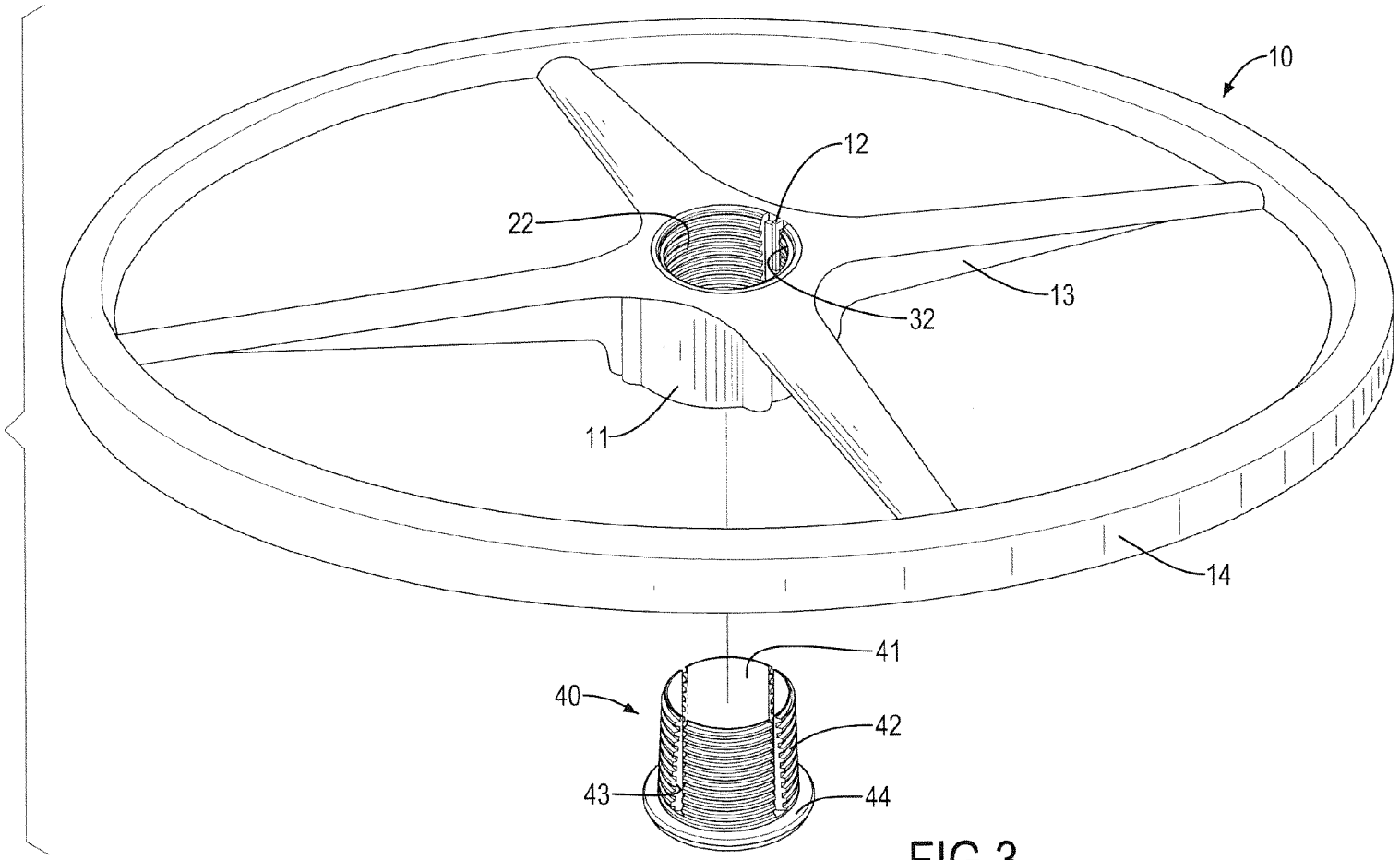
FIG. 3 is an exploded perspective view of the adjustment device in FIG. 1.
Figure 4:
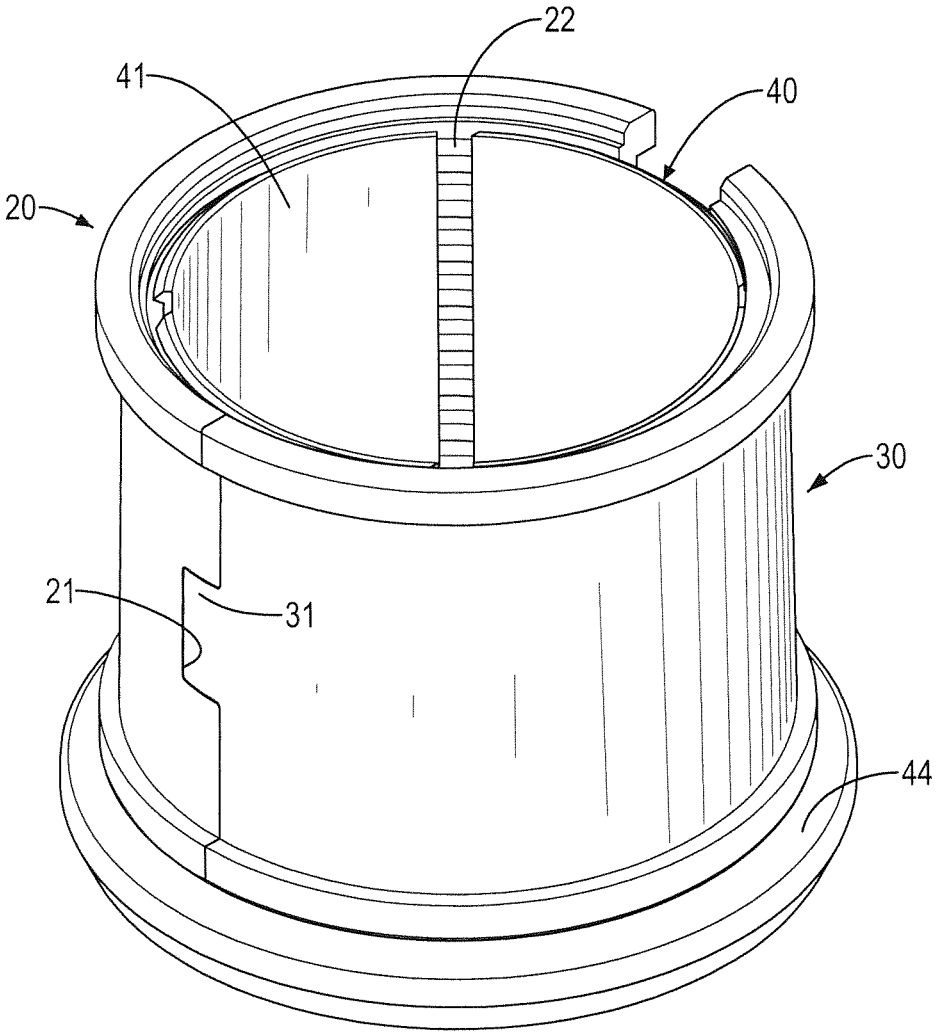
FIG. 4 is an enlarged perspective view of the adjustment device in FIG. 1.

With reference to FIGS. 1 and 2, a preferred embodiment of an adjustment device of a chair with a foot ring in accordance with the present invention is mounted around a leg tube 51 of a chair leg 50. The adjustment device has a foot ring 10, a first positioning unit 20, a second positioning unit 30 and a tightening collar 40.

The foot ring 10 has a mounting tube 11, a block 12, multiple ribs 13 and a ring frame 14. The mounting tube 11 is hollow. The block 12 is formed on an inner surface of the mounting tube 11. The ribs 13 are radially connected with an outer surface of the mounting tube 11. The ring frame 14 is connected with ends of the ribs 13 at positions opposite to the mounting tube 11. The ring frame 14 is provided for pedaling of a user.

The first positioning unit 20 and the second positioning unit 30 are mounted in the mounting tube 11 and face each other, wherein the block 12 abuts one of the first positioning unit 20 and the second positioning unit 30. The first positioning unit 20 and the second positioning unit 30 are curved sheets.

The first positioning unit 20 has a recess 21 and an inner threaded portion 22. The recess 21 is formed in an end of the first positioning unit 20 along a curved extension direction of the first positioning unit 20. The inner threaded portion 22 is formed on a side of the first positioning unit 20, wherein the side faces towards the second positioning unit 30. The inner threaded portion 22 is arranged inclined relative to the mounting tube 11.

The second positioning unit 30 has a bump 31 and an inner threaded portion 32. The bump 31 is formed on an end of the second positioning unit 30 along a curved extension direction of the second positioning unit 30. The bump 31 is engaged in the recess 21. The inner threaded portion 32 is formed on a side of the second positioning unit 30, wherein the side of the second positioning unit 30 faces towards the first positioning unit 20. The inner threaded portion 32 is arranged inclined relative to the mounting tube 11. The inner threaded portions 22, 32 of the first positioning unit 20 and the second positioning unit 30 can be connected with each other to form a tapered and fully threaded structure.

The tightening collar 40 is mounted around the leg tube 51 of the chair leg 50 and has a collar body 41, an outer threaded portion 42, multiple slits 43 and a flange 44. The collar body 41 is hollow and tapered. A taper ratio of the collar body 41 matches a taper ratio of the threaded structure formed by the first positioning unit 20 and the second positioning unit 30. The outer threaded portion 42 is formed on a side of the collar body 41. The slits 43 are formed through the collar body 41 at intervals along a tapered extending direction of the collar body 41. The flange 44 annularly protrudes from a bottom of the collar body 41. When the flange 44 abuts bottoms of the first positioning unit 20 and the second positioning unit 30, the outer threaded portion 42 engages with the inner threaded portions 22, 32 of the first positioning unit 20 and the second positioning unit 30.

Figure 6:
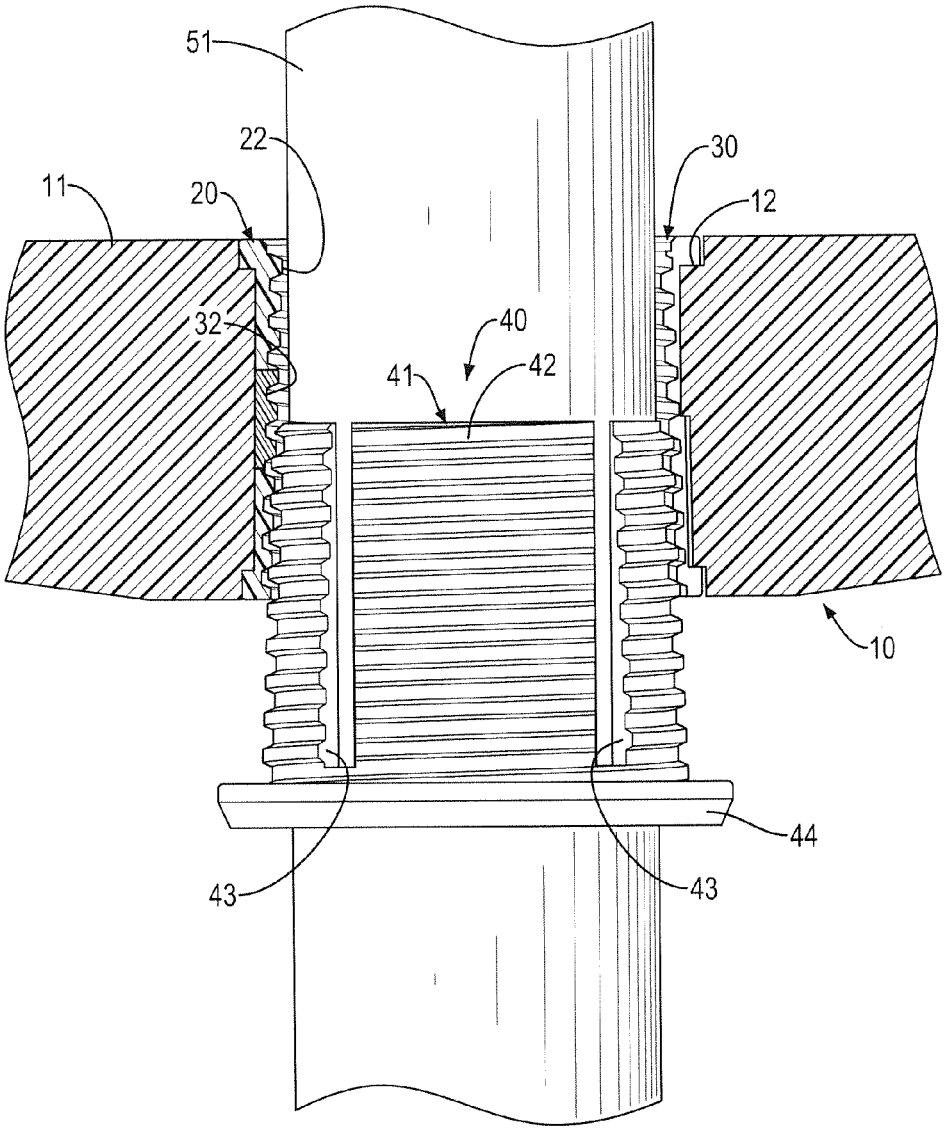
FIG. 6 is an enlarged operational side view in partial section of the adjustment device in FIG. 1.
Figure 7:
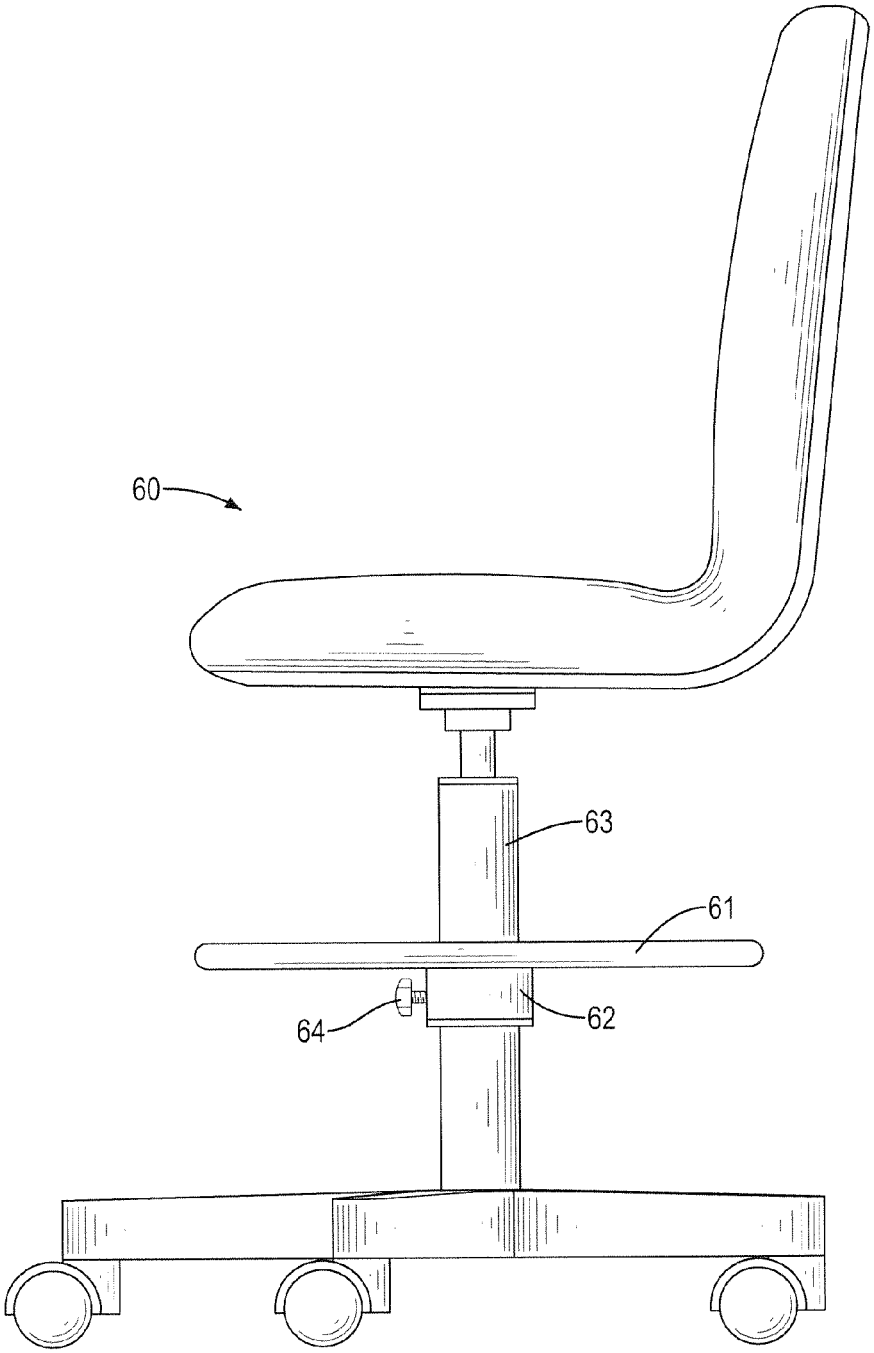
FIG.7 PRIOR ART
FIG. 7 is an operational side view of a conventional foot ring.

In use, the tightening collar 40 is mounted around the leg tube 51 of the chair leg 50. A height of the foot ring 10 relative to the leg tube 51 is decided according to the mounting position of the foot ring 10. The first positioning unit 20 and the second positioning unit 30 are mounted in the mounting tube 11. The mounting tube 11 is mounted around the tightening collar 40 from top to bottom (as shown in FIG. 6), and then the foot ring 10 is rotated, such that the block 12 can drive the first positioning unit 20 and the second positioning unit 30 to rotate.

Figure 5:
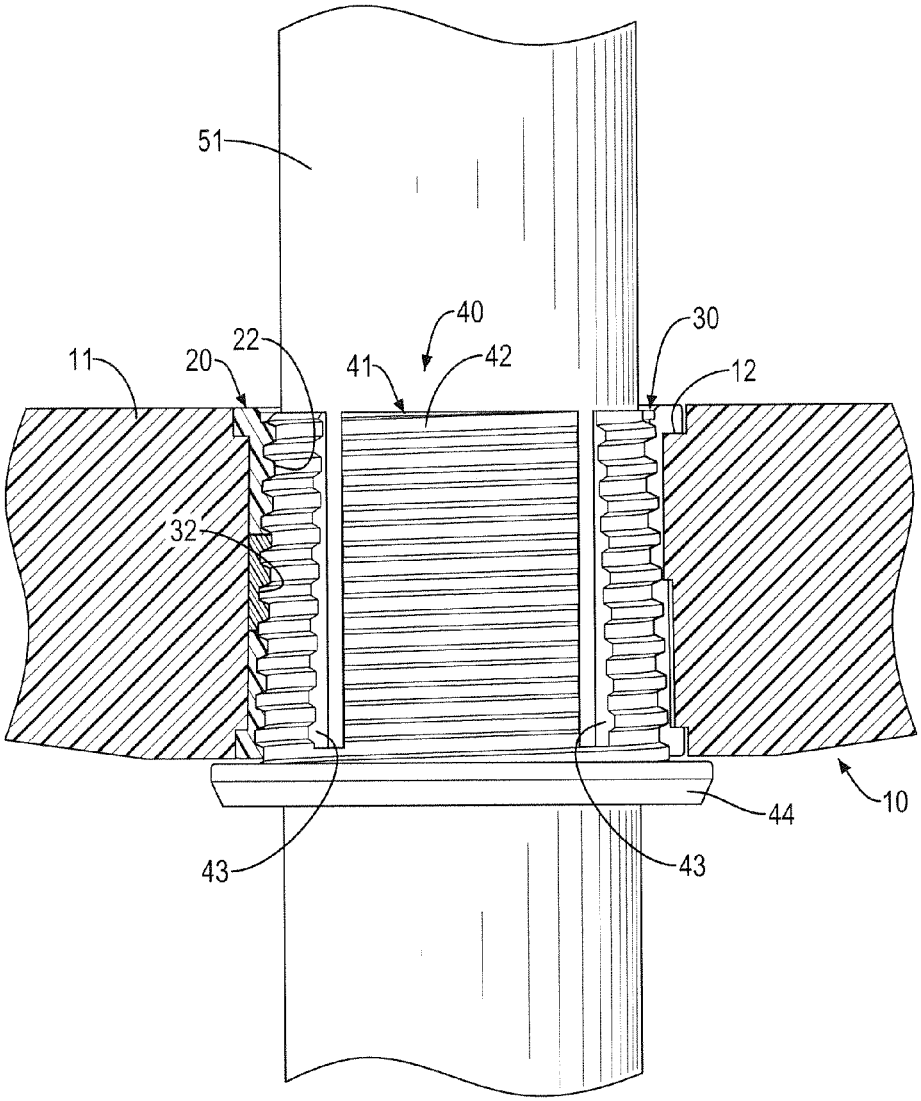
FIG. 5 is an enlarged side view in partial section of the adjustment device in FIG. 1.

After the threaded structure formed by the inner threaded portions 22, 32 of the first positioning unit 20 and the second positioning unit 30 engages the outer threaded portion 42 and the flange 44 abuts the bottoms of the first positioning unit 20 and the second positioning unit 30, the foot ring 10 is assembled around the leg tube 51 (as shown in FIG. 5). The first positioning unit 20 and the second positioning unit 30 are locked around the tightening collar 40. The tightening collar 40 is annularly forced by a clamping force from the first positioning unit 20 and the second positioning unit 30, such that the tightening collar 40 can clamp the leg tube 51 annularly with uniform force. Therefore, the foot ring 10 can be assembled around the leg tube 51 firmly. Furthermore, the user can hold the ring frame 14 to rotate the foot ring 10 with one hand, wherein the ribs 13 can provide a long moment arm for the user, such that the user can assemble the foot ring effortlessly.

From the above description, it is noted that the present invention has the following advantages:

1. When the position of the foot ring 10 needs to be adjusted, a hand of the user holds the seat of the chair, and the other hand of the user holds the ring frame 14 to loosen the foot ring 10. After the position of the foot ring 10 is decided, the foot ring 10 is then tightened. Therefore, the adjustment process is convenient for the user. Furthermore, the foot ring 10 can provide a long moment arm by the ribs 13, such that the user can assemble the foot ring 10 effortlessly.

2. The foot ring 10 is mounted around the leg tube 51 by the tightening collar 40 annularly with uniform force, such that the leg tube 51 can be kept from damage. Therefore, the life of the leg tube 51 can be prolonged.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An adjustment device of a chair having:

a foot ring having a mounting tube being hollow;

a block formed on an inner surface of the mounting tube;

multiple ribs radially connected with an outer surface of the mounting tube; and a ring frame connected with ends of the ribs at positions opposite to the mounting tube;

a first positioning unit being curved, mounted in the mounting tube and having an inner threaded portion formed on a side of the first positioning unit;

a second positioning unit being curved, mounted in the mounting tube, facing towards the first positioning unit, and having an inner threaded portion formed on a side of the second positioning unit, wherein the side of the second positioning unit faces towards the first positioning unit, the inner threaded portions of the first positioning unit and the second positioning unit are connected with each other to form a tapered and fully threaded structure, and the block abuts one of the first positioning unit and the second positioning unit; and a tightening collar engaging with the threaded structure formed by the inner threaded portions of the first positioning unit and the second positioning unit, and having a collar body being hollow and tapered, wherein a taper ratio of the collar body matches a taper ratio of the threaded structure formed by the first positioning unit and the second positioning unit;

an outer threaded portion formed on a side of the collar body and engaging the inner threaded portions of the first positioning unit and the second positioning unit; and at least one slit formed through the collar body longitudinally.

2. The adjustment device of a chair as claimed in claim 1, wherein the first positioning unit further has a recess formed in an end of the first positioning unit; and the second positioning unit further has a bump formed on an end of the second positioning unit and engaging in the recess.

3. The adjustment device of a chair as claimed in claim 2, wherein the tightening collar has four slits formed through the collar body at intervals.

4. The adjustment device of a chair as claimed in claim 3, wherein the tightening collar further has a flange annularly protruding on an end of the collar body and abutting ends of the first positioning unit and the second positioning unit.

* * * * *